US009970185B2

(12) United States Patent
Rajšter

(10) Patent No.: US 9,970,185 B2
(45) Date of Patent: May 15, 2018

(54) FLUSH TANK WITH DISCHARGE VALVE AND TRIGGERING MECHANISM THEREFOR

(71) Applicant: Aleš Rajšter, Ljubljana-Crnuce (SI)

(72) Inventor: Aleš Rajšter, Ljubljana-Crnuce (SI)

( * ) Notice: Subject to any disclaimer, the term of this patent is extended or adjusted under 35 U.S.C. 154(b) by 162 days.

(21) Appl. No.: 14/891,118

(22) PCT Filed: May 16, 2014

(86) PCT No.: PCT/IB2014/061481
§ 371 (c)(1),
(2) Date: Nov. 13, 2015

(87) PCT Pub. No.: WO2014/184776
PCT Pub. Date: Nov. 20, 2014

(65) Prior Publication Data
US 2016/0076235 A1 Mar. 17, 2016

(51) Int. Cl.
*E03D 5/12* (2006.01)
*E03D 1/14* (2006.01)
*E03D 5/02* (2006.01)

(52) U.S. Cl.
CPC ..... *E03D 1/14* (2013.01); *E03D 5/024* (2013.01)

(58) Field of Classification Search
USPC ..... 4/407
See application file for complete search history.

(56) References Cited

U.S. PATENT DOCUMENTS 1,501,620 A 7/1924 Reed
2,341,116 A 2/1944 Owens
2,838,765 A * 6/1958 Hosking ..... E03D 1/302 4/407
2,862,210 A * 12/1958 Traver ..... E03D 5/024 4/407
3,151,338 A * 10/1964 Nunnery ..... E03D 1/00 4/380

FOREIGN PATENT DOCUMENTS

FR 1111426 A 2/1956

* cited by examiner

*Primary Examiner* — Lauren Crane
(74) *Attorney, Agent, or Firm* — Saliwanchik, Lloyd & Eisenschenk

(57) ABSTRACT

The present invention refers to a flush tank providing a receptacle with a discharge valve and a triggering mechanism therefore. A first end of an adapter (5) is inserted with a press fit into a discharge projection (3) of the receptacle (2) for the flush water. A discharge tube (7) to discharge the flush water from said receptacle (2) is attached to a second end of said adapter (5), wherein a triggering mechanism (8) is arranged within said tube (7), said mechanism releasing flow of the water out of said receptacle (2). The triggering mechanism comprises a body (16) in which a first hollow piston (22) is slidably arranged whereby lifting the first piston initiates a small flush. A second piston (25) is in turn slidably arranged in the first piston whereby lifting the second piston initiates a large flush. The pistons are both actuated pneumatically.

6 Claims, 1 Drawing Sheet

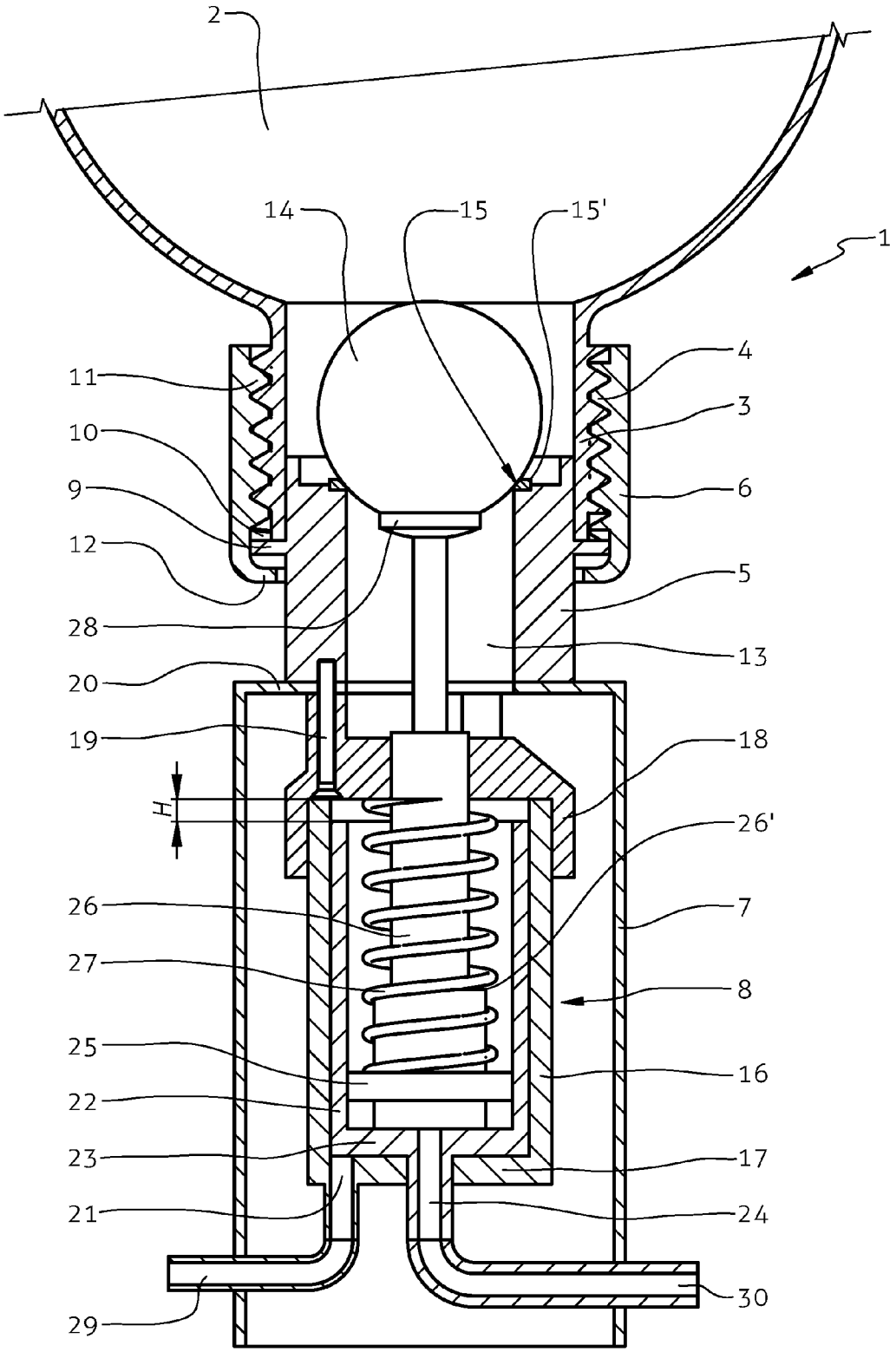
2
14
15
15'
1
11
10
9
12
28
20
19
H
26
27
25
22
23
21
29
4
3
6
5
13
18
26'
7
8
16
17
24
30

FLUSH TANK WITH DISCHARGE VALVE AND TRIGGERING MECHANISM THEREFOR

CROSS REFERENCE TO RELATED APPLICATIONS

This application is a National Stage Application of International Application Number PCT/IB2014/061481, filed May 16, 2014; which claims priority to Slovenia Application No. P-201300120, filed May 16, 2013; both of which are incorporated herein by reference in their entirety.

The present invention refers to a triggering mechanism of a discharge valve for a flush tank, preferably to a triggering mechanism of a discharge valve for a flush tank which is used with toilet devices.

Flush tanks used with toilet devices are generally known and comprise a relatively large reservoir of a flush water, a water inlet, an inlet valve and a triggering mechanism to activate flushing. Said triggering mechanism is formed in a manner that different quantities of water may be released from the reservoir. However, a drawback of said flush tanks is relatively high flush water consumption that can not be controlled, as well a complex and costly production of said tanks.

It is the object of the present invention to create a triggering mechanism of a discharge valve of a flush tank which remedies the drawbacks of the known solutions.

According to the present invention, the object as set above is solved with characteristics disclosed in claim 1.

The invention is further described in detail by way of non-limiting embodiment, and with a reference to the accompanying drawing showing a cross-section of a triggering mechanism according to the invention in a vertical plane.

A flush tank 1 comprises a flush water receptacle 2, preferably a pressure receptacle 2 of flush water, said receptacle 2 being formed at the side thereof facing a toiled device (not shown) with a cylindrical discharge projection 3 having an external thread 4. The first end of an adapter 5 is inserted with a relative press fit into said projection 3, said adapter 5 being associated by means of a nut 6 with said projection 3. A discharge tube 7 for discharging flush water from said receptacle 2 is attached to the second end of said adapter 5, whereas the free end of said tube 7 is associated with said toilet device (not shown). A triggering mechanism 8 by means of which the water flow is released from said receptacle 2 is arranged inside said discharge tube 7. Said adapter 5 is formed at the place of the connection with said projection 3 with a radially extending flange 9 which is pressed by means of said nut 6 and via a first gasket 10 against the front side of said projection 3. Said nut 6 is provided with an internal thread 11 meshing into said external thread 4 of the projection 3. Furthermore, said nut 6 comprises a web 12 extending radially inwards and over the entire circumference thereof, said web 12 cooperates in essence with said flange 9. Said adapter 5 is formed with a centric through hole 13 connecting the inside of the receptacle 2 and the discharge tube 7. Said through hole 13 is closed at the side of the receptacle 2 by means of a stand-alone blocking element 14 which, in the present embodiment is represented as a ball 14. In the position when the water flow from the receptacle 2 is blocked, said ball 14 seats in a sealing manner on the seat 15 of said through hole 13 being provided with a gasket 15'.

Said triggering mechanism 8 comprises a cylindrical body 16 closed at the first end thereof with a bottom 17 and at the other end with a cover 18. Additionally, said cover 18 is intended to fix the triggering mechanism 8 to the adapter 5 represented in the present embodiment by means of a plurality of threaded means 19. Simultaneously, the discharge tube 7 is fixed by means of said connection, the fixing section 20 thereof being arranged between the adapter 5 and the cover 18. Said bottom 17 is formed with a through hole 21 to supply a first control fluid, a water from the public water supply in the present embodiment, supplied by actuating a first actuator not shown. Furthermore, inside said body 16 there is arranged in a sealing manner a first hollow piston 22 being formed at the side facing the bottom 17 of the body 16 with a bottom 23. Said bottom 23 is formed with a tubular projection 24 which penetrates the bottom 17 of the body 16 and serves as a supply line for a second control fluid, a water from the public water supply in the present embodiment, supplied by actuating a second actuator not shown. In addition, the bottom 23 is subjected to a fluid load when said first actuator is actuated. According to the present invention, said hollow piston 22 is formed in a manner that in the starting position, i.e. idle position, rests with the bottom 23 thereof against the bottom 17 of the body 16, whereas the free end thereof is spaced for the length of the feed motion H of the piston 22 from the inner surface of the cover 18 facing the piston 22.

Furthermore, a second piston 25 is slidably arranged in a sealing manner inside said hollow piston 22, said second piston 25 being formed with a piston rod 26 which in a sealing manner penetrates said cover 18 being slidably engaged therewith, whereas the free end of the piston 25 faces said bottom 23 of the hollow piston 22. Said free end of the piston 25 is subjected via said tubular projection 24 to a fluid load when said second actuator is actuated. said piston rod 26 is provided with a return spring 27 cooperating with the first end thereof with the piston 25, and with the second end thereof with the cover 18. The free end of the piston rod 26 is provided with a flange 28 extending to the proximity of said blocking element 14 and is intended to cooperate therewith.

When a small water quantity is to be released from the receptacle 2 of the flush tank 1, said first actuator is to be actuated which enables delivering the water via a supply line 29 as long as said first actuator is active. This means, that the actuator is activated as long as the user acts upon it and, respectively, is released when the user estimates that the release water is sufficient to do the flushing. Water supplied via said line 29 fluidly loads through the hole 21 in the bottom 17 of the body 16 the surface facing the bottom 17 of the bottom 23 of the hollow piston 22, resulting in the hollow piston to move in the longitudinal direction toward the cover 18 until it rests with the free end thereof against said cover 18 which, in the presented embodiment, represents a feed stop of the hollow piston 22. Simultaneously with the movement of the hollow piston 22, the second piston 25 moves as well due to the fact that said bottom 23 presses against said second piston 25 when the hollow piston 22 moves. Since said second piston 25 extends via the piston rod 26 and the flange 28 up to the close proximity of the blocking element 14, said movement of the hollow piston 22, and indirectly also of the second piston 25, results in that said piston rod 26 via the flange pushes the blocking element 14 from the seat 15 of the adapter 5, thus, releasing the water flow form the receptacle 2. When the hollow piston 22 stops to be fluidly loaded, said return spring 27 pushes the pistons 22, 25 into the initial position thereof. As a result, acting of the piston rod 26 onto the blocking element 14 is also brought to a stop, causing the water pressure in the receptacle 2 to push the blocking element 14 back to the seat and, thus, stops the water flow from the receptacle 2.

When a large water quantity is to be released from the receptacle 2 of the flush tank 1, said second actuator is to be actuated which enables delivering the water via a supply line 30. In this case, the user presses said second actuator for a short time period and releases it. Said second actuator is selected as an actuator with a throttling return motion known per se so that the actuator, when the user does not act upon it any more, does not return in its initial closed position, the return motion depends on time, though. The water which is delivered via said line 30 fluidly loads the piston 25 via the hole 21 in the bottom 23 of the hollow piston, and pushes it in the longitudinal direction toward the cover 18. The piston 25 feed, which in this case is essentially larger than the feed H of the piston 22 with the release of water small quantity from the receptacle 2, is limited in a manner known per se, for instance by means of a shoulder 26' on the piston rod 26. Since said second piston 25 extends via piston rod 26 and the flange 28 up to the close proximity of the blocking element 14, said movement of the second piston results in the piston rod 26 to push the blocking element 14 away from the seat 15 of the adapter 5, thus releasing the water flow from the receptacle 2. By means of decreasing fluid load of the second piston 25 due to the throttling return motion of the second actuator, it is prevented for the blocking element 14 to return to fast to the seat 15 so that the entire receptacle 2 may be emptied. After the fluid load to the piston 25 stops the latter returns by means of the return spring 27 in its initial position. As a result, the acting of the piston rod onto the blocking element 14 stops, thus, causing the water pressure in the receptacle 2 to push the blocking element 14 back to the seat 15 and to close the water flow out of the receptacle 2.

Other embodiments of the invention are possible without departing from the spirit and scope of the invention. Thus, an embodiment is possible where the triggering mechanism 8 is arranged in the receptacle 2.

The invention claimed is:

1. A triggering mechanism of a discharge valve for a flush tank, characterized in that a first end of an adapter is operably attached to a discharge projection of a receptacle for containing a flush water, a discharge tube to discharge the flush water from said receptacle is attached to a second end of said adapter, a triggering mechanism being arranged within said discharge tube, said triggering mechanism comprising:

a hollow cylindrical body having a bottom;

a first hollow piston slidingly arranged in a sealing manner inside the cylindrical body;

a second piston slidably arranged in a sealing manner inside the first hollow piston, a first end of the second piston being formed with a piston rod; and a return spring within the first hollow piston, where the return spring biases the first hollow piston and the second piston against the bottom of the hollow cylindrical body, such that operation of the triggering mechanism causes a releasing flow of the flush water out of said receptacle.

2. The triggering mechanism according to claim 1, characterized in that said adapter is formed with a centric through hole connecting the inside of the receptacle and the discharge tube, said through hole being closed at the side of the receptacle by means of a stand-alone blocking element that cooperates in a sealing manner with a seat of said through hole.

3. The triggering mechanism according to claim 2, characterized in that said triggering mechanism further comprises free end of the piston rod that is provided with a flange extending to close proximity of said blocking element and intended to cooperate therewith.

4. The triggering mechanism according to claim 3, characterized in that a bottom of the cylindrical body is formed with a through hole to supply a first control fluid, and a bottom of the first hollow piston is formed with a tubular projection that penetrates the bottom of the cylindrical body and serves as a supply line for a second control fluid, wherein the bottom of the first hollow piston is subjected to a fluid load from the through hole, whereas a free end of the second piston facing said bottom of the hollow piston is subjected to a fluid load via said tubular projection.

5. The triggering mechanism according to claim 3, characterized in that said hollow piston is formed in a manner that in an initial position the bottom thereof rests against the bottom of the cylindrical body, whereas the free end thereof is spaced for the length of a feed motion (H) of the piston from the inner surface of a cover facing the piston.

6. The triggering mechanism according to claim 5, characterized in that the piston feed, which is larger than the feed (H) of the piston, is limited by means of a shoulder on the piston rod.

* * * * *